United States Patent [19]

McGinnis, III et al.

[11] Patent Number: 4,802,424

[45] Date of Patent: Feb. 7, 1989

[54] FURNACE FOR HAZARDOUS MATERIALS

[75] Inventors: Francis K. McGinnis, III, Dallas, Tex.; John F. Enright, III, Lancaster, Pa.

[73] Assignee: Nass, Inc., York, Pa.

[21] Appl. No.: 199,276

[22] Filed: May 26, 1988

[51] Int. Cl.[4] ..... F23G 5/00; F23G 5/10; F23G 5/12

[52] U.S. Cl. ..... 110/250; 110/229; 110/236; 110/257; 110/269

[58] Field of Search ..... 110/229, 236, 250, 255, 110/257, 346, 269, 329

[56] References Cited

U.S. PATENT DOCUMENTS

| | | | |
|---|---|---|---|
| 3,648,630 | 3/1972 | Hobbs et al. | 110/346 |
| 3,707,355 | 12/1972 | Anderson | 110/250 X |
| 3,745,670 | 7/1973 | Hartwig | 110/269 X |
| 3,871,286 | 3/1975 | Henriksen | 110/257 |
| 4,109,590 | 8/1978 | Mansfield | 110/270 X |
| 4,765,256 | 8/1988 | Caughey | 110/229 |

*Primary Examiner*—Edward G. Favors

[57] ABSTRACT

A continuous thermal treatment furnace for converting hazardous materials into environmentally acceptable materials, including a continuous belt for conveying hazardous materials through a substantially air-tight heating chamber having heating elements to thermally detoxify the hazardous materials on the belt, a charging zone and a discharging zone, each being ducted to convey volatiles to an off-gas handling system in which hazardous volatiles are converted to environmentally acceptable materials, the discharge zone being at least partially water-jacketed to cool discharged solids, the continuous belt being returned to the charging zone outside of the heating chamber in order for the belt to be cooled.

12 Claims, 1 Drawing Sheet

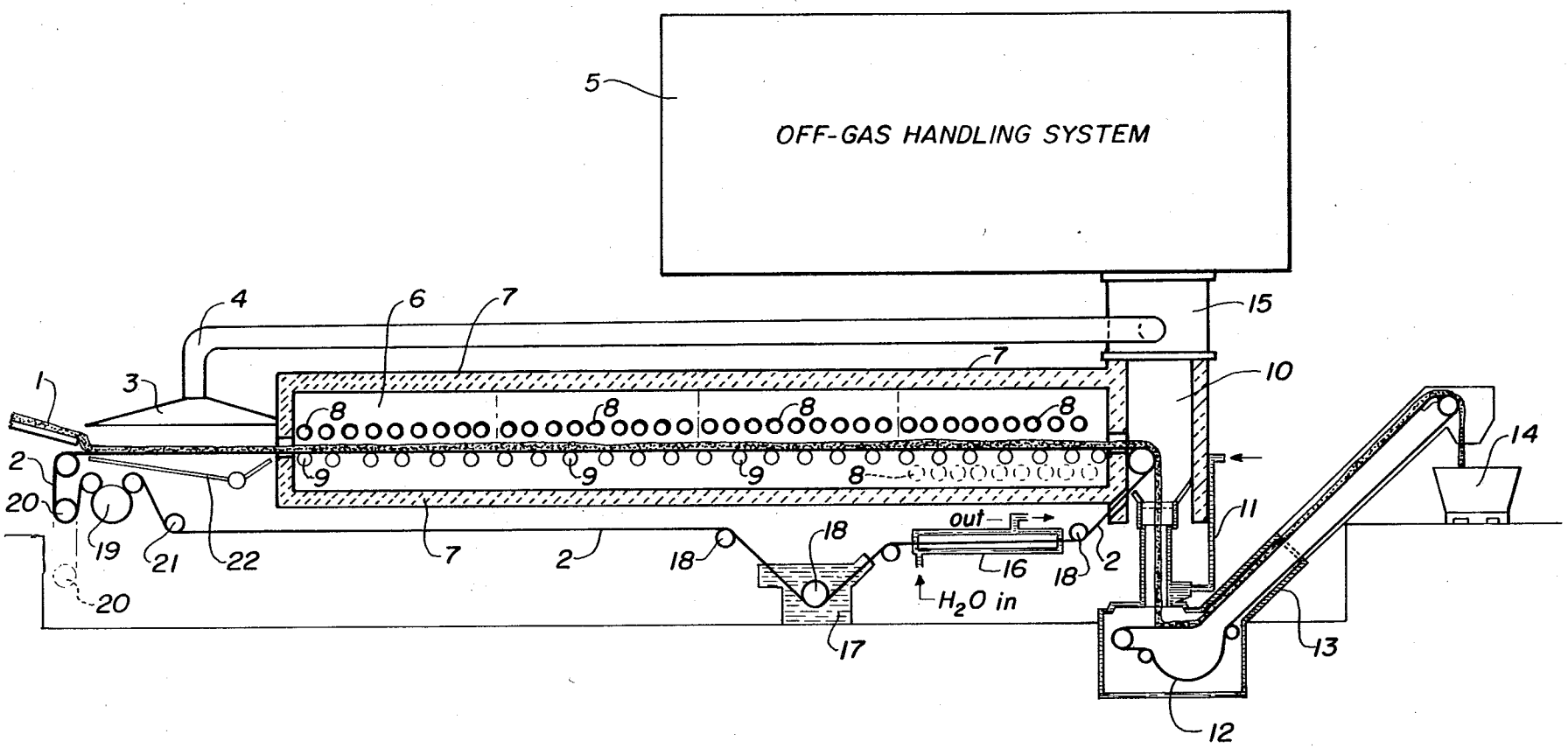
OFF-GAS HANDLING SYSTEM
out
$H_2O$ in

FURNACE FOR HAZARDOUS MATERIALS

BACKGROUND OF THE INVENTION

The invention relates to the safe treatment and disposal of hazardous materials. The hazardous materials may be of any kind that cannot normally be handled or disposed of by conventional means. Such hazardous materials may include contaminated soil, construction debris, sludges, and other solid or semi-solid materials which contain toxic substances or toxic metals such as arsenic, lead, bismuth, and the like. The hazardous materials may also include sludges which may not be poisonous, but which present problems of disposal. Such sludges may be those resulting from the manufacture of paints or other filled coatings, including sludges from painting or plating operations. These sludges will contain solids admixed with binders, carriers, thinners, many or all of which may be inflammable materials not suitable for mere discharge into the normal water-treating systems.

The prior technology includes descriptions of incinerators such as those contained in U.S. Pat. No. 3,648,630-Hobbs et al. and U.S. Pat. No. 4,202,282-Hobbs et al. Whiles these and similar technologies are adapted to the incineration of sludges on a continuous basis, they are not adapted to treat a broad range of hazardous materials in an environmentally safe way.

SUMMARY OF THE INVENTION

The invention contemplates passing a continuous belt through a thermal treatment furnace. The belt is adapted to retain the solids in a hazardous material along with any liquids normally associated with such a material. The belt will be fabricated from links made of a suitable stainless steel to resist the conditions in the furnace. The opening between the links that make up the belt will normally be very small to inhibit the loss of particles through the belt. A successful belt is one that measures 6 feet by 140 feet long formed from links of a nickel-chromium alloy to provide small openings and having good strength and light weight.

The heating is supplied by heating elements, preferably radiant tubes, spanning the width of the furnace and positioned close to the surface of the moving belt carrying the hazardous materials. Depending on the amount of heating needed, a single heating zone containing 3 or 4 heating elements may suffice, but preferably, the incinerator will have a series of heating zones, each adjustable as to temperature in that zone, in order to completely detoxify the hazardous materials and convert them to environmentally acceptable material. The tubes may be inert electric heating elements. The tubes alternatively may be adapted to carry combustion products and hot gases to supply sufficient heat to reach the desired process temperature.

A charging zone is positioned at one end of the thermal treatment furnace and is adapted to spread the hazardous materials to be treated on the moving belt. Since such hazardous materials often contain volatiles at this stage of the process, the charging zone should have a hood which is ducted to an off-gas handling system. At the other end of the furnace, the discharge zone will also be ducted to convey volatiles to the off-gas handling system. It will be appreciated that all the volatiles and gases driven off during the heating cycle in the furnace will emerge in the discharge zone. Hence, the duct from the discharge zone will normally be much larger than the duct from the charge zone to accommodate a far greater volume of volatiles and gases. The discharge zone is jacketed or otherwise adapted for cooling the mass of materials being discharged from the furnace. Cooling water jackets normally suffice to cool the discharged materials and to render them more appropriate for handling in the open atmosphere. Normally a discharge conveyor belt will carry the discharged materials through an additional water-cooled discharge area in order that the discharged materials may be dumped into a suitable ash pit or container for removal.

From the discharge zone, the continuous belt returns to the charge zone outside of the heated zones of the furnace. While such a return adaptation will air cool the belt to some extent, it is preferred that the belt is passed through an indirect cooler, water jacketed, followed by a water bath. This provides gradual cooling and insures that when the continuous belt arrives at the charge zone, it will be sufficiently cool to prevent premature heating and possible decomposition of the hazardous material being charged at the charge zone. The water bath may also serve as a water seal to prevent gases from leaking out of the discharge zone where the belt exits.

BRIEF DESCRIPTION OF THE DRAWING

The FIGURE shows a simplified sideview of the thermal treatment unit of the present invention in which the hazardous materials will move from left to right as one views the drawing.

DETAILED DESCRIPTION OF PREFERRED EMBODIMENTS

Referring to the drawing, hazardous materials 1 are conveyed by any convenient means to the continuous moving belt 2 under the hood 3 bearing a duct 4 to convey any volatile off gases to the off-gas handling system 5. The belt 2 enters the thermal treatment furnace. The furnace 6 has insulated walls 7 which may be fabricated of any conventional material normally used in furnaces or incinerators. As shown in the drawing, each of the four zones in the furnace 6 shows nine heating elements 8. In a successful adaptation of the incinerator, each heating element 8 measures 6 feet long, and 2 inches in diameter, and is heated to a temperature of about 1800 degrees Fahrenheit by the passage of about 150 amperes at 200 volts. The belt 2 is supported in its passage though the oven 6 by supporting rolls 9.

While the drawing shows that the heating elements 8 are positioned above the layer of hazardous materials 1 on the belt 2, heating elements may be positioned below the belt as shown by dashed circles 8 prime near the exit end of the furnace 6.

The heat treated hazardous materials are conveyed by the belt 2 to the discharge zone 10 having at the lower portion thereof a water cooled jacket 11. The materials are picked up by the discharge belt 12, conveyed through an additional cooling 13 and finally dumped into the hopper 14 for disposal. The discharge zone 10 has a large duct 15 to convey all the off-gases and volatiles to the off-gas handling system 5.

This off-gas handling system may be a high-temperature oxidizing system, a scrubber adapted to remova alkaline or acidic off-gases, a chemical treating system in the nature of a packed tower with counter-current reactive liquids, or any combination of these, including a particulate precipitator. Since the off-gases are often combustible, the off-gas handling system 5 will very often include a high temperature oxidizer with associated particle separators in order to render all the volatiles environmentally acceptable and to remove substantially all particulate matter from the final exhaust stream.

The continuous belt 2 leaves the discharge zone 10 and starts its return to the charge zone beneath the hood 3 by passing through the water cooler 16. In the drawing, the belt 2 is shown actually passing through a water bath 17 to complete the cooling. Idler rolls 18 guide the belt 2 in its return to the charge zone beneath the hood 3. Drive roll 19, driven by conventional means, supplies the power to keep the belt 2 moving through the system. The same driving system may also power the support rolls 9 to minimize the tension on the belt 2. Roller 20 maintains tension in the belt 2 and compensates for expansion and contraction. Tracking roller 21 keeps the belt 2 in proper alignment on the drive roll 19 as the belt 2 approaches it. Depending on the nature of the hazardous material being treated, a drip pan 22 may be positioned below the belt 2 and under the hood 3 to trap any liquid seepage that may occur. Such seepage may be separately treated or recycled into the incinerator by means not shown in the drawing.

What I claim is:

1. In a continuous furnace for thoroughly treating hazardous materials to convert such materials to environmentally acceptable materials, the furnace including a continuous belt adapted to carry hazardous materials through at least one heated zone without release of noxious fumes or noxious solids to the environment, the improved combination comprising:

(a) a charging zone located in the open atmosphere adapted to spread the hazardous material charge on the moving belt before introduction into a heated zone, said charging zone being equipped with an exhaust hood ducted to convey to an off-gas handling system any volatile materials emitted while spreading;

(b) at least one substantially air-tight heated high temperature zone adapated to drive off volatiles and detoxify solids on the belt without release to the enviornment;

(c) an enclosed discharged zone having cooled walls and adapted to:

(i) discharge volatiles to an off-gas handling system for conversion of hazardous volatiles to environmentally acceptable materials;

(ii) convey solids to a solids collecting zone;

(d) means to move the continuous belt outside of the heating zone from the discharge zone to the charging zone; and (e) means positioned between the discharge zone and the charging zone to cool the continuous belt prior to its return to the charging zone.

2. A furnace according to claim 1 in which said belt is controlled in its movement through said furnace by roller means to maintain said belt in proper position.

3. A furnace according to claim 1 in which said high-temperature zone is heated with radiant tubes.

4. A furnace according to claim 3 in which said radiant tubes are heated electrically.

5. A furnace according to claim 1 in which said off-gas handling system comprises a high-temperature oxidation system.

6. A furnace according to claim 1 in which said charging zone is equipped with a drip pan to collect excess liquids from said hazardous materials being charged.

7. A furnace according to claim 1 in which said high-temperature zone is heated by tubes positioned above said continuous belt.

8. A furnace according to claim 1 in which said high-temperature zone is heated by tubes positioned below said continuous belt.

9. A furnace according to claim 1 having four high-temperature zones.

10. A furnace according to claim 1 in which at least a portion of the walls of said discharge zone are cooled by water jackets.

11. A furnace according to claim 1 in which the conveyor in said discharge zone for conveying detoxified solids to a solids collecting zone is enclosed for at least a portion of its length by a water cooling jacket.

12. A furnace according to claim 1 in which the off-gases are passed through a particle separator immediately upon exiting the furnace.

* * * * *